US008087299B1

(12) United States Patent
Liao

(10) Patent No.: US 8,087,299 B1
(45) Date of Patent: Jan. 3, 2012

(54) TARGET PRESSURE DETECTION DEVICE

(75) Inventor: Yin-Hsi Liao, Yonghe (TW)

(73) Assignee: Guay Guay Trading Co., Ltd., Taipei County (TW)

( * ) Notice: Subject to any disclaimer, the term of this patent is extended or adjusted under 35 U.S.C. 154(b) by 60 days.

(21) Appl. No.: 12/820,142

(22) Filed: Jun. 22, 2010

(51) Int. Cl.
*G01L 7/22* (2006.01)

(52) U.S. Cl. ..... 73/713; 73/744

(58) Field of Classification Search ..... None
See application file for complete search history.

(56) References Cited

U.S. PATENT DOCUMENTS 4,398,428 A * 8/1983 Kato ..... 73/861.05
5,251,489 A * 10/1993 Lalin ..... 73/861
5,295,396 A * 3/1994 Lalin et al. ..... 73/861
5,440,925 A * 8/1995 Padden et al. ..... 73/253
2009/0000395 A1* 1/2009 Brown et al. ..... 73/861.47

* cited by examiner

*Primary Examiner* — Andre Allen
(74) *Attorney, Agent, or Firm* — Leong C. Lei

(57) ABSTRACT

A target pressure detection device (1) includes a housing (10), a resilient membrane (12), and a pressure detection unit (14). The housing (10) forms a chamber (102) having an open end and the housing (10) forms a through hole (104). The resilient membrane (12) is mounted to the housing (10) to cover and close the open end of the housing (10) so as to set the chamber (102) in an air-tight condition. The pressure detection unit (14) is mounted to the through hole (104) and forms therein an accommodation compartment (140) that movably receives therein a floating element (142). The accommodation compartment (140) receives therein a sensor (144). The sensor (144) can effectively detect a movement of the floating element (142) and thus the precision of detection of the target can be improved through detecting change of airflow.

3 Claims, 6 Drawing Sheets

TARGET PRESSURE DETECTION DEVICE

TECHNICAL FIELD OF THE INVENTION

The present invention generally relates to a target pressure detection device that enhances the detection of target shooting.

DESCRIPTION OF THE PRIOR ART

Survival games are getting popular recently. Gun shooting, however, is not legal in certain areas/countries and one substitute for gun shooting is the so-called BB gun game, which provides a recreational activity resembling gun shooting. The BB gun game is often played in a specific field where targets are installed. The BB target currently available in the market is quite simple and monotonous. Several types of BB target are available, including paper targets and simply-erected targets, which, once shot, collapse and must be re-erected manually. Power targets are also available but surfer being easily damaged, lacking of expandability, poor detection capability, and being not sufficiently sensitive, making it sometimes troublesome in use and not convenient. A professional shooting range requires complicated facility that is generally not affordable by general hobbyist of shooting games.

The existing target adopts digital detection to determine the points obtained. However, such a process is of insufficiency of sensitivity and the costs for installation, assembling, and maintenance are expensive, making it not economic. Further, precise calculation and determination of points acquired can not be properly done once the detection device fails to work and this may affects the final result of a competition.

SUMMARY OF THE INVENTION

In view of such problems of the existing shooting targets, the present invention aims to provide a target pressure detection device that facilitates detection of a shot on the target.

The primary objective of the present invention is to provide a target pressure detection device, comprising a housing, a resilient membrane, and a pressure detection unit. The housing comprises a wall delimiting a chamber having an open end and the housing forms a through hole in the wall. The resilient membrane is mounted to the housing to cover and close the open end of the housing to set the chamber in an air-tight condition. The pressure detection unit is mounted to the through hole and forms therein an accommodation compartment that movably receives therein a floating element. The accommodation compartment receives therein a sensor. The sensor can effectively detect a movement of the floating element. Since the chamber is closed by the resilient membrane to be set in an airtight condition, when the resilient membrane is subjected to an external force, the air contained in the chamber is compressed and a change in air flowing is induced, whereby the floating element that is received in the pressure detection unit that is in fluid communication with the chamber is caused to move and the movement is detected by the sensor. Thus, the precision of detection of the target can be improved.

Another objective of the present invention is to provide a target pressure detection device that is simple in structure and cheap in cost.

A further objective of the present invention is to provide a target pressure detection device that improves the detection result of shots on a target so as to minimize a dispute between players of a shooting game.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
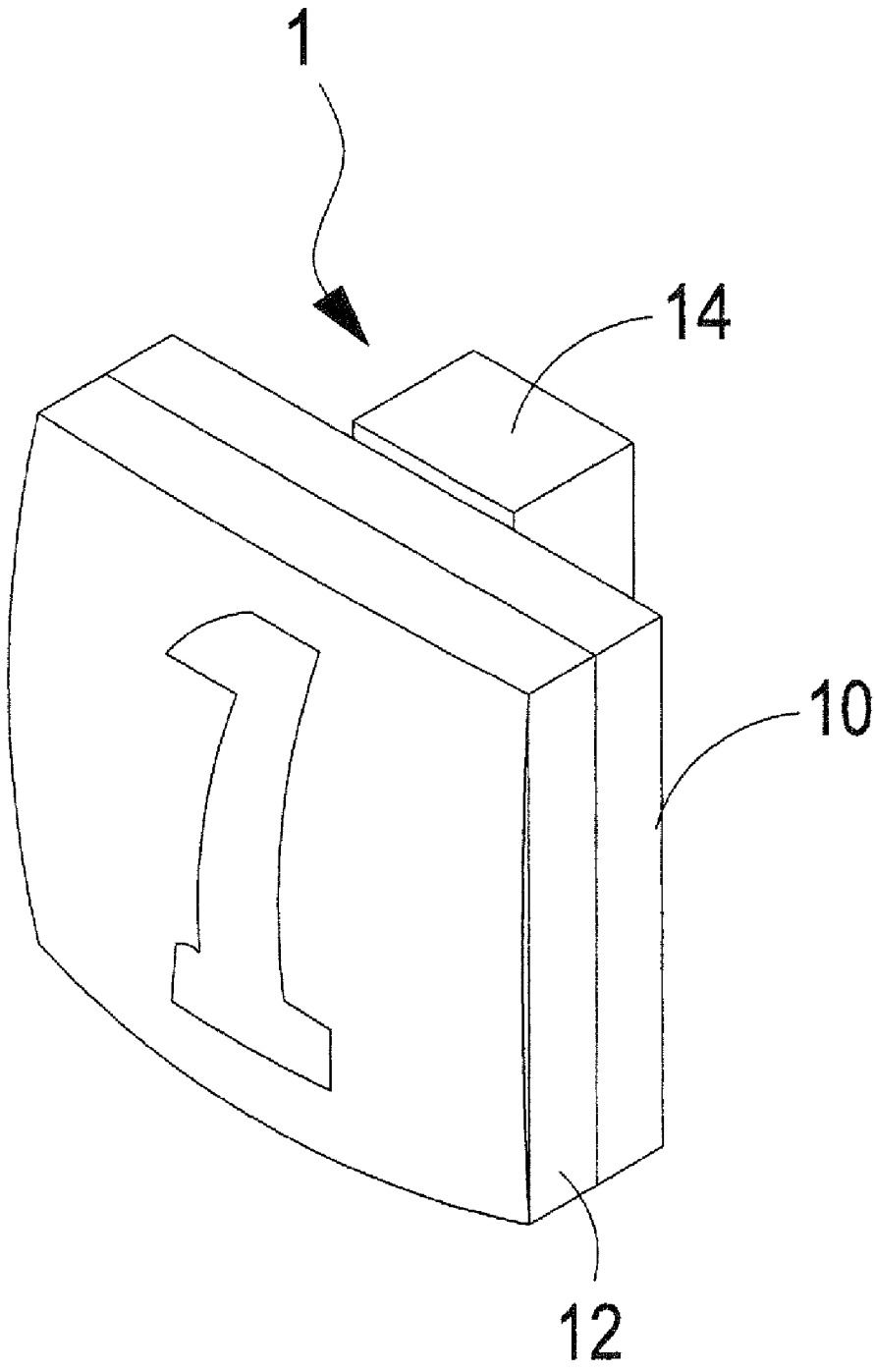
FIG. 1 is a perspective view of a preferred embodiment of the present invention.
Figure 2:
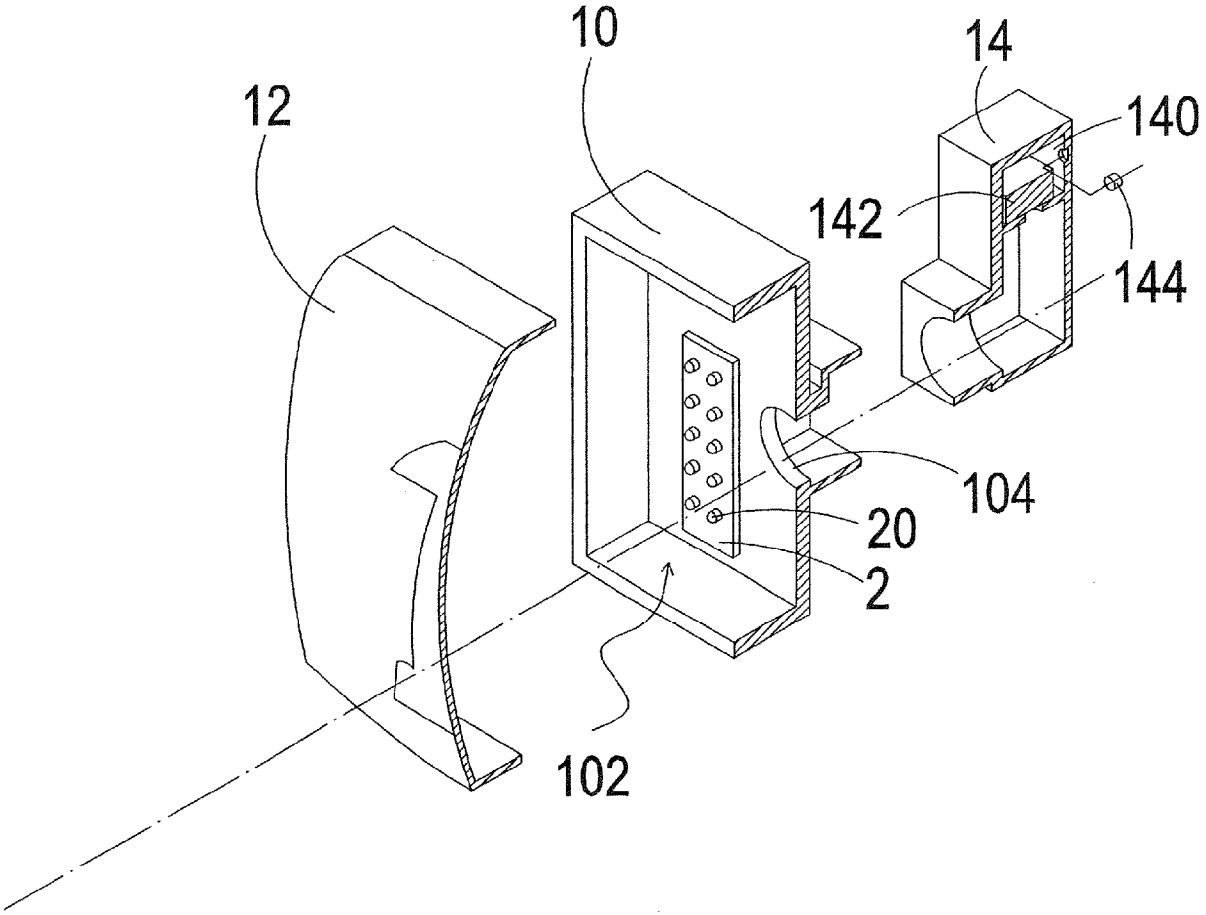
FIG. 2 is an exploded view of the preferred embodiment of the present invention.

Referring to FIGS. 1 and 2, which are respectively a perspective view and an exploded view of a target constructed in accordance with a preferred embodiment of the present invention, the present invention provides a target pressure detection device to be used with a target. The target pressure detection device 1 comprises a housing 10, a resilient membrane 12, and a pressure detection unit 14. The housing 10 comprises a wall delimiting a chamber 102 that defines an open end. The housing 10 also forms a through hole 104 in the wall thereof. The open chamber 102 of the housing 10 is covered and closed by the resilient membrane 12, so that the chamber 102 is set in an airtight condition. The through hole 104 receives the pressure detection unit 14 mounted thereto in a fluid-communicating manner. The pressure detection unit 14 forms therein an accommodation compartment 140, which receives, in a movable manner, a floating element 142 (made of polylone or expanded polystyrene) therein. A sensor 144 is mounted in the accommodation compartment 140 to effectively detect the movement of the floating element 142. The housing 10 also receives therein a circuit board 2 that controls and drives a set of illumination elements 20. The circuit board 2 is electrically connected to the sensor 144.

Figure 3:
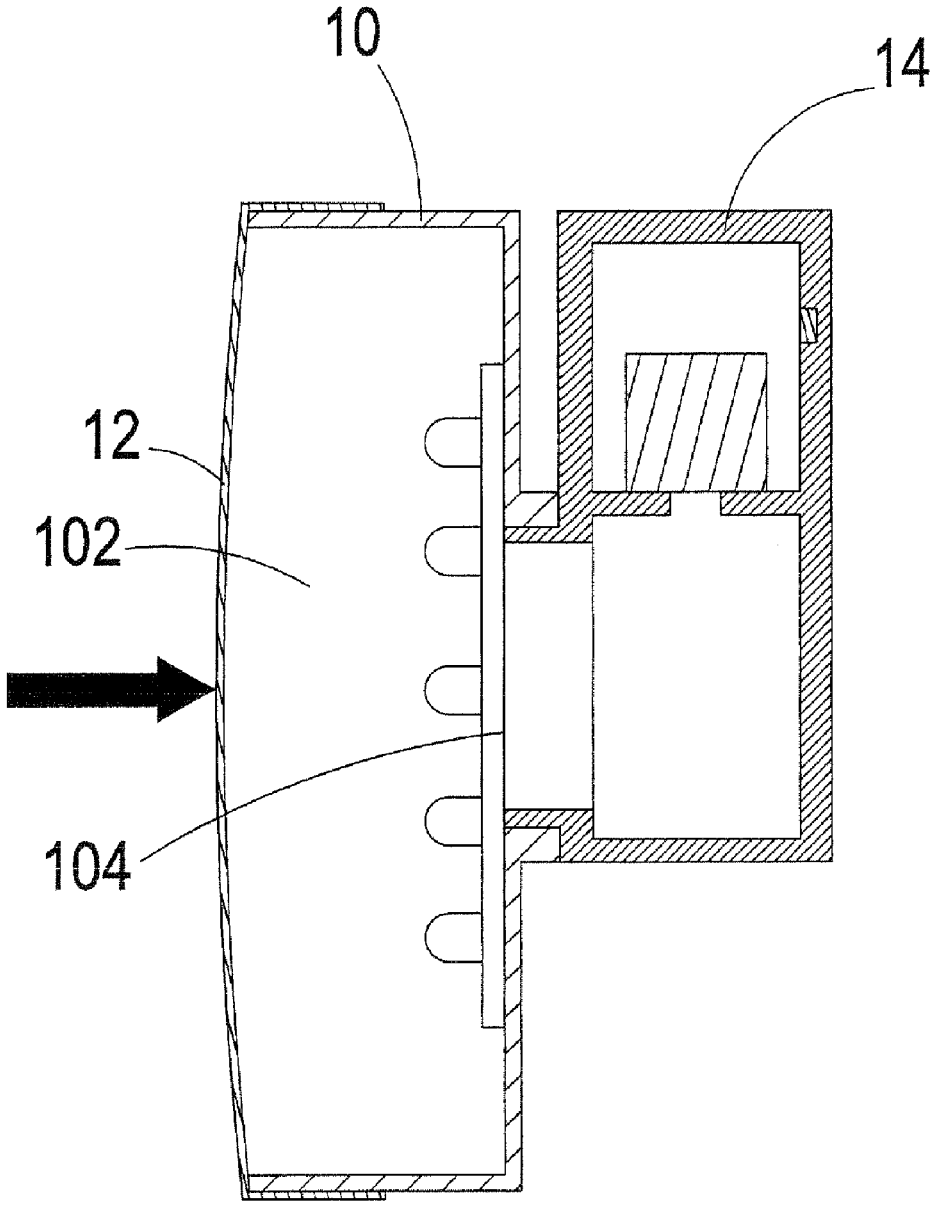
FIG. 3 is a cross-sectional view showing a first phase of an operation of the preferred embodiment of the present invention.
Figure 4:
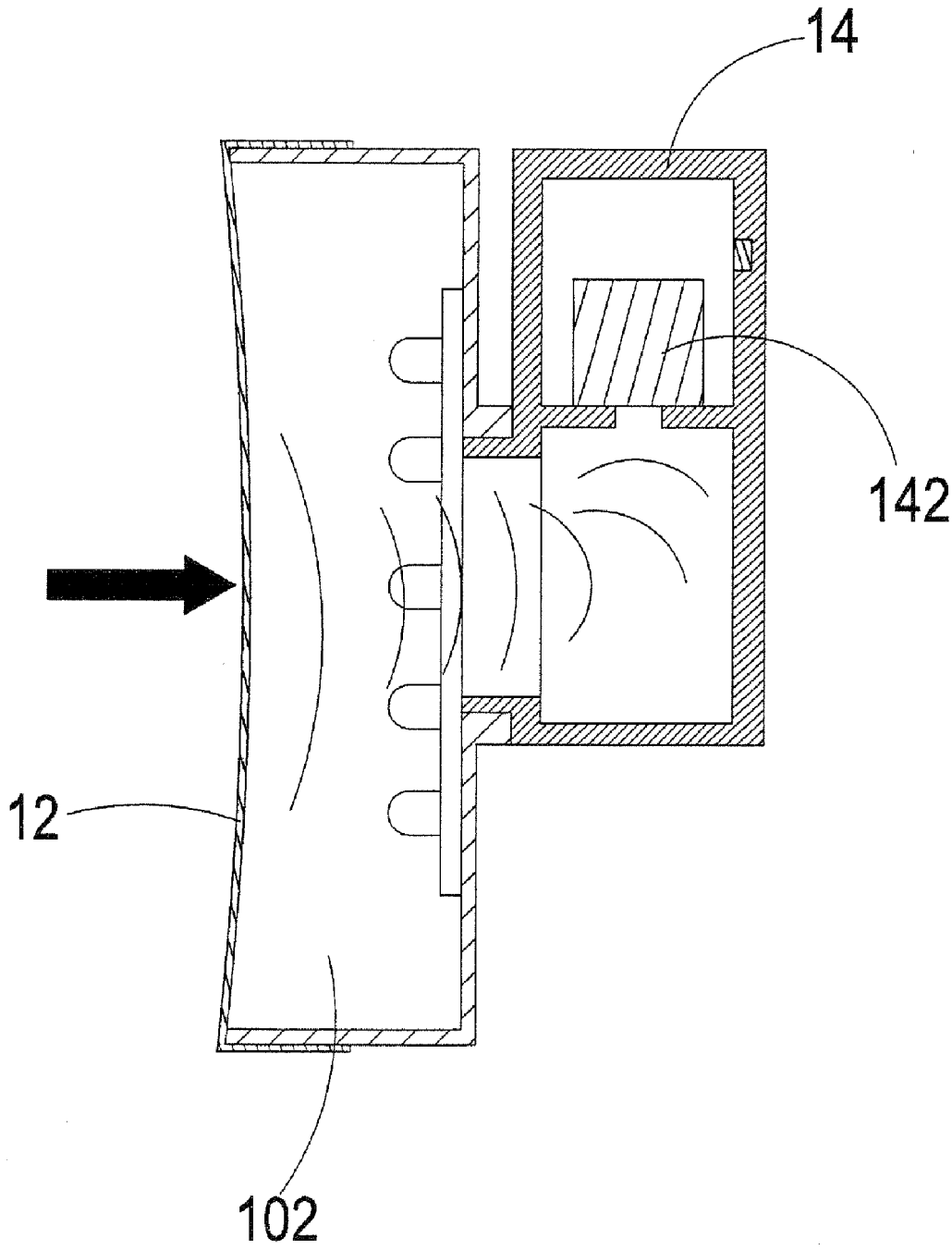
FIG. 4 is also a cross-sectional view showing a second phase of the operation of the preferred embodiment of the present invention.
Figure 5:
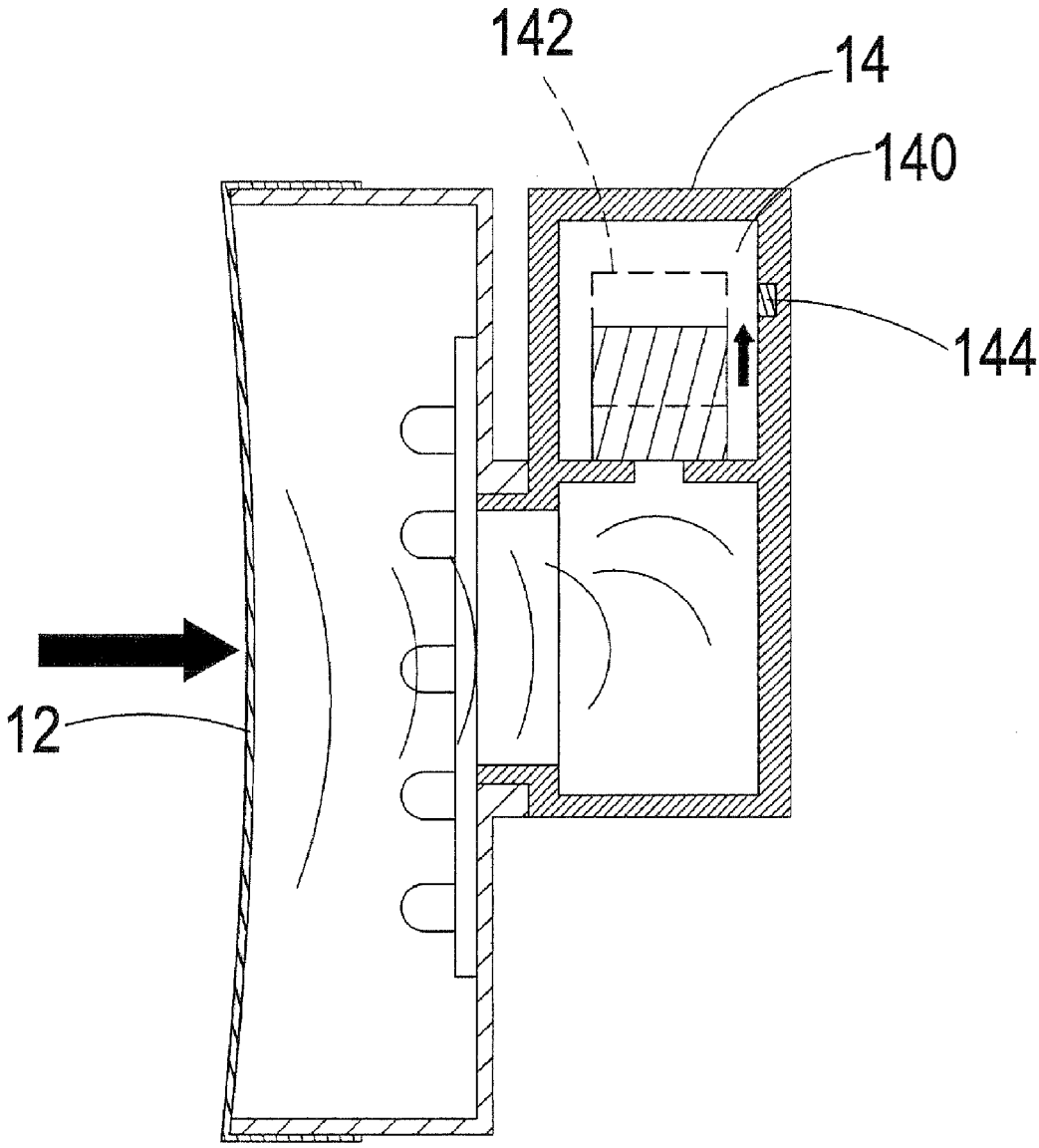
FIG. 5 is also a cross-sectional view showing a third phase of the operation of the preferred embodiment of the present invention.

With the above-described arrangement, the operation of the present invention will be described with reference to FIGS. 3-5, which are cross-sectional views showing the operation of the target. As shown in the drawings, the pressure detection unit 14 is mounted to the through hole 104 of the housing 10 so that air is allowed to freely move between the pressure detection unit 14 and the chamber 102 for the housing 10 is covered by the resilient membrane 12 to make the chamber 102 in an airtight condition.

When the resilient membrane 12 is subjected to contact by an external object, such as a BB, the resilient membrane 12 undergoes deformation, inducing a shock wave in the air contained in the chamber 102, and the floating element 142 received in the pressure detection unit 14 is driven by the airflow to move and change the position thereof.

When the sensor 144 of the accommodation compartment 140 detects the movement of the floating element 142, a detection signal is transmitted to a computation unit (not shown). Thus, even the contact is made at a periphery of the resilient membrane 12, the contact on the resilient membrane 12 can be detected, and therefore, the precision of detection is enhanced.

Figure 6:
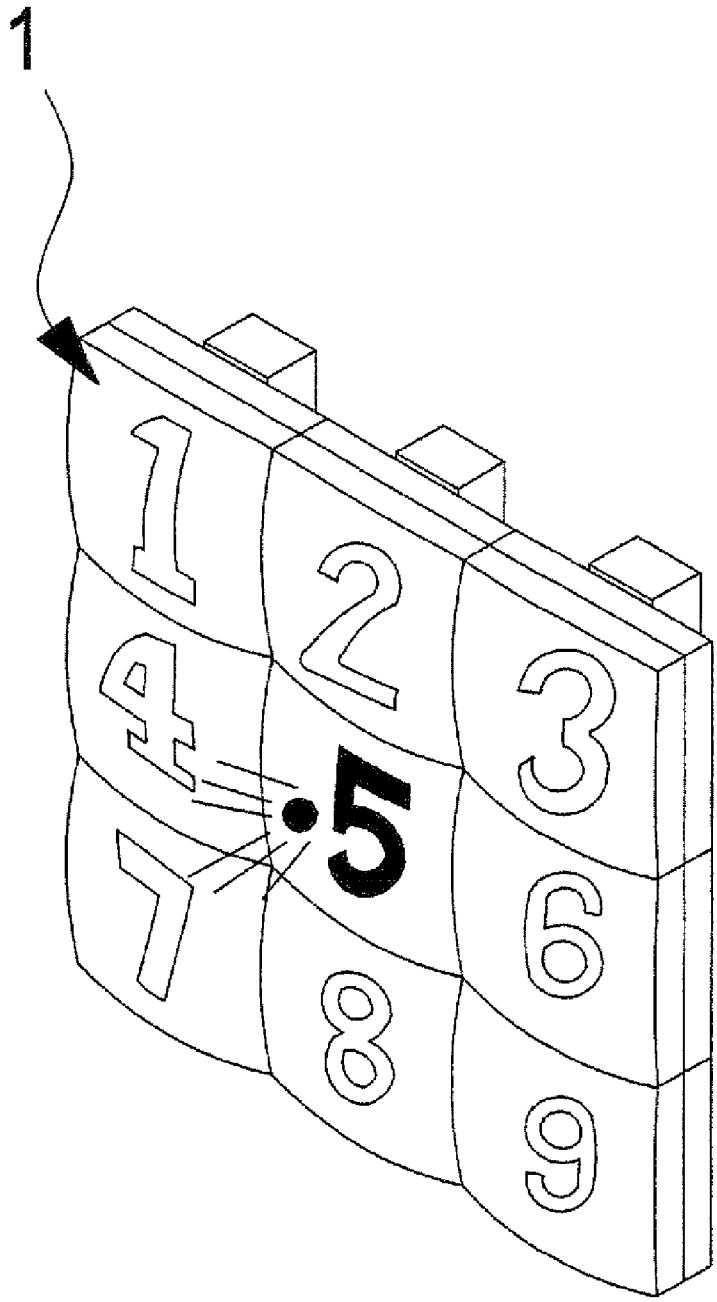
FIG. 6 is a perspective view illustrating an application of the preferred embodiment of the present invention.

FIG. 6 is a perspective view showing an application of the target according to the present invention. Reference is also made to FIG. 2. In the illustrated application, multiple units of the target of the present invention are arranged in a three-by-three square matrix. According to the present invention, to display various possible conditions that each unit of the target pressure detection device of the present invention can be of, including target to be shot, target that has been shot, target that acquires a point, the housing 10 receives therein a circuit board 2 that controls and drives a set of illumination elements 20 and the circuit board 2 is electrically connected to the sensor 144 in order to properly display the various conditions of each target unit.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A target pressure detection device, comprising:

a housing, which forms a chamber having an open end, the housing forming a through hole;

a resilient membrane, which is mounted to the housing to cover and close the open end of the housing so as to set the chamber in an air-tight condition; and a pressure detection unit, which is mounted to the through hole and forms therein an accommodation compartment that movably receives therein a floating element, the accommodation compartment receiving therein a sensor that detects movement of the floating element.

2. The target pressure detection device according to claim 1 further comprising a circuit board that is received in the housing to control and drive a set of illumination elements.

3. The target pressure detection device according to claim 1, wherein the floating element is made of polylone.

* * * * *